US007198136B2

(12) United States Patent
Urata

(10) Patent No.: US 7,198,136 B2
(45) Date of Patent: Apr. 3, 2007

(54) ELEVATOR DEVICE FOR A MULTI-SKY-LOBBY SYSTEM

(75) Inventor: Masazumi Urata, Tokyo-to (JP)

(73) Assignee: Otis Elevator Company, Farmington, CT (US)

( * ) Notice: Subject to any disclaimer, the term of this patent is extended or adjusted under 35 U.S.C. 154(b) by 475 days.

(21) Appl. No.: 10/661,141

(22) Filed: Sep. 11, 2003

(65) Prior Publication Data

US 2005/0077115 A1 Apr. 14, 2005

(51) Int. Cl.
*B66B 1/18* (2006.01)

(52) U.S. Cl. ..... 187/383; 187/389; 187/249; 187/380; 187/385; 187/387; 187/414

(58) Field of Classification Search ..... 52/29, 52/32; 187/383, 389, 382, 249, 247, 380, 187/385, 387, 414
See application file for complete search history.

(56) References Cited

U.S. PATENT DOCUMENTS 1,939,729 A * 12/1933 Stark ..... 187/249
1,943,119 A * 1/1934 James ..... 198/794
2,052,690 A * 9/1936 Austin ..... 187/249
3,651,893 A * 3/1972 Berkovitz ..... 187/254
3,658,155 A * 4/1972 Salter ..... 198/798
3,750,849 A * 8/1973 Berkovitz ..... 187/266
3,973,686 A * 8/1976 Rivers ..... 414/595
5,090,515 A * 2/1992 Takahashi et al. ..... 187/249
5,419,414 A * 5/1995 Sakita ..... 187/391
5,601,156 A * 2/1997 McCarthy et al. ..... 187/249
5,657,835 A * 8/1997 Bittar ..... 187/249
5,660,249 A * 8/1997 Powell et al. ..... 187/249
5,663,538 A * 9/1997 Sakita ..... 187/382
5,665,625 A * 9/1997 Sandhu et al. ..... 438/396
5,773,772 A * 6/1998 McCarthy et al. ..... 187/289
5,785,153 A * 7/1998 Powell et al. ..... 187/249
5,823,299 A * 10/1998 Wierschke et al. ..... 187/277
5,861,586 A * 1/1999 McCarthy et al. ..... 187/289
5,865,274 A * 2/1999 Kiji et al. ..... 187/380
5,877,462 A * 3/1999 Chenais ..... 187/249
6,955,245 B2 * 10/2005 Dunser et al. ..... 187/382

FOREIGN PATENT DOCUMENTS

JP 2003073043 A * 3/2003
WO WO 2004058616 A1 * 7/2004

* cited by examiner

*Primary Examiner*—Jeanette Chapman

(57) ABSTRACT

An elevator system is provided with multiple sky lobbies to reduce the space required for elevator shafts and the space required for the entire elevator system, as well as the required elevator speed and motor capacity.

Sky lobbies $Ls_1$–$Ls_x$ are arranged above building lobby $L_G$ at ground level, with a prescribed number of floors between them. Shuttle elevator (1) stops only at building lobby $L_G$ and sky lobbies $Ls_1$–$Ls_x$, and passes through the various floors between lobbies by making them an express region. Local elevators service the floors in each bank between adjacent sky lobbies. Local elevators (2*a*), (2*c*), (2*e*), (2*g*) for the odd-numbered banks are arranged along the same elevator shaft, and local elevators (2*b*), (2*d*), (2*f*) for the even-numbered banks are arranged along another same elevator shaft.

7 Claims, 8 Drawing Sheets

ELEVATOR DEVICE FOR A MULTI-SKY-LOBBY SYSTEM

TECHNICAL FIELD OF THE INVENTION

The present invention pertains to an elevator device that can move up and down along an elevator shaft of a building. More specifically, the present invention pertains to an elevator device of a multi-sky-lobby system in a high-rise building characterized by the fact that it has local elevators that stop at every floor and a shuttle elevator that moves in an express region and stops only at prescribed floors.

BACKGROUND OF THE INVENTION

Two types of elevators are used in high-rise buildings; those of the zone system and those of the sky lobby system. In the zone system, as shown in FIG. 8(*a*), the service floors are divided into plural banks by means of units A–E, and an express region is defined for operation between the building lobby $L_G$ (the lobby is on the ground floor) and the various banks except the lowermost bank.

In FIG. 8, "P" stands for elevator pit; "M" stands for the mechanical section; and "L" stands for the lobby. The densely hatched areas indicate service floors (serviced floors), and the widely hatched areas indicate express regions (bypassed floors).

In FIG. 8(*a*), unit A provides service in the region between building lobby $L_G$ and a prescribed floor $Ls_1$ above.

In unit B, the region between building lobby $L_G$ and floor $Ls_1$ is an express region, and Unit B provides service in the region between floor $Ls_1$ and floor $Ls_2$, which is above said floor $Ls_1$ by a prescribed number of floors.

In unit C, the region between building lobby $L_G$ and floor $Ls_2$ is an express region, and unit C provides service in the region between said floor $Ls_2$ and upper floor $Ls_3$, which is above said floor $Ls_2$ by a prescribed number of floors.

In unit D, the region between building lobby $L_G$ and floor $Ls_3$ is an express region, and unit D provides service in the region between said floor $Ls_3$ and upper floor $Ls_4$, which is above said floor $Ls_3$ by a prescribed number of floors.

In unit E, the region between building lobby $L_G$ and floor $Ls_4$ is an express region, and unit E provides service in the region between said floor $Ls_4$ and upper floor $Ls_x$, which is above said floor $Ls_4$ by a prescribed number of floors.

It has been found that, usually, a building height of 40–50 floors (200 m high) is the limit for said zone system. This system has been used, e.g., in the Tokyo Metro Building, the Shinjuku Nomura Building, and the Sunshine 60 Building in Japan, and in the Empire State Building and other buildings in the United States.

On the other hand, in the sky lobby system, as shown in FIG. 8(*b*), a sky lobby acts as a relay lobby on floor $Ls_3$ at approximately the midpoint of the total height of the building. There is an express (direct) shuttle elevator that goes only to this sky lobby. Then, local elevators are placed in a zone constitution with said building lobby and sky lobby as their respective starting points. (The name "sky lobby" denotes the position of the lobby when viewed from the ground floor).

In FIG. 8(*b*), unit A provides service for the region from building lobby $L_G$ to upper floor $Ls_1$ which is above said building lobby by a prescribed number of floors.

In unit B, the region between building lobby $L_G$ and floor $Ls_1$ is an express region, and unit B provides service in the region between said floor $Ls_1$ and upper floor $Ls_2$, which is above said floor $Ls_1$ by a prescribed number of floors.

In unit C, the region between building lobby $L_G$ and floor $Ls_2$ is an express region, and unit C provides service in the region between said floor $Ls_2$ and upper floor $Ls_3$ (sky lobby), which is above said floor $Ls_2$ by a prescribed number of floors.

Unit D stops only at building lobby $L_G$ and said sky lobby (floor $Ls_3$); its movement is based on designating this region as an express region.

Unit A' is a bank arranged along the same elevator shaft as that of said unit A, and it provides service for the region between sky lobby (floor $Ls_3$) and floor $Ls_4$, which is above said floor $Ls_3$ by a prescribed number of floors.

Unit B' is a bank arranged along the same elevator shaft as that of said unit B, where the region from the sky lobby (floor $Ls_3$) to said floor $Ls_4$ is an express region. It provides service for the region between floor $Ls_4$ and floor $Ls_5$, which is above said floor $Ls_4$ by a prescribed number of floors.

The sky lobby system can be used effectively in buildings at least 200 m tall. For example, this system has been used in the Petronas Tower in Malaysia, the Jingmao and Bank of China Buildings in China, the Central Plaza Building in Hong Kong, the T&C Tower in Taiwan, as well as the Yamao Park Tower and the 1-Roppongi Plan Building in Japan.

However, in skyscrapers at least 300 m tall, the number of local elevators zones divided by the sky lobby into upper and lower portions increases (lower, middle, higher, . . . ). For ultrahigh skyscrapers 400 m tall or higher, as the number of banks (zones) of local elevators increases, two sky lobbies may be used in another example of the sky lobby system.

The elevator scheme using this system has shuttle elevators dedicated to the first and second sky lobbies. Together with the ground-level lobby (building lobby), the three lobbies, that is, upper, middle and lower lobbies, are the base points. As a result, an economical design is realized. For example, this system has been adopted in the Sears Tower and the World Trade Center in the United States.

(1) In the zone system shown in FIG. 8(*a*), by adjusting the number of banks for each specific height (floor number) of the building, it is possible to ensure a uniform service level. However, as the building height increases, the number of banks of the elevator increases. Consequently, the area of the elevator shaft of the express zone of the higher bank (express region) becomes larger, and this affects the overall space of the elevator. Also, the space of the elevator shaft for each floor in the direction of the lower bank also becomes larger, so that the effective space for construction of the lower floors decreases, which is undesirable.

Elevators that service the higher banks, such as unit D and unit E, are required to move at high speed. As a result, the required capacity of the motor (hoisting devices) increases, and, since they are operated at high speed, the noise level also increases, which is undesirable.

Also, a long time is required to move between banks, which is a problem. That is, when moving from a given floor between building lobby $L_G$ and floor $Ls_1$ to a prescribed floor between floor $Ls_2$ and floor $Ls_3$, the passenger first takes unit A to go to floor $Ls_1$, where the passenger transfers to unit B to go to floor $Ls_2$; the passenger then transfer to unit C to reach the destination floor. This route requires the passenger to make two transfers, and all of the local elevator regions are used. Consequently, the travel time is very long.

In another route, the passenger takes unit A to go to building lobby $L_G$, where the passenger transfers to unit C to reach the destination floor. In this case, if the passenger arrives at building lobby $L_G$ immediately after unit C elevator has left, the passenger must wait a long time since said unit C must service the service area and then return to building lobby $L_G$.

(2) In the sky lobby system shown in said FIG. 8(*b*), the main line (local elevator) is divided into upper and lower portions, so that the express region can be more than halved as compared with said zone system. Also, the speed can be reduced. As a result, an economical design (smaller space) can be realized.

However, as in the aforementioned zone system, the time for moving between banks is also long in this case. That is, for example, when going from a given floor between building lobby $L_G$ and floor $Ls_1$ and a given floor between floor $Ls_2$ and floor $Ls_3$, the passenger first takes unit A to go to floor $Ls_1$, where the passenger transfers to unit B and goes to floor $Ls_2$; then, the passenger transfers to unit C to reach the destination floor. This route requires the passenger to make two transfers, and all local elevator regions are used. Consequently, the travel time is very long.

In another route, the passenger takes unit A to go to building lobby $L_G$, where the passenger transfers to unit C to reach the destination floor. In this case, if the passenger arrives at building lobby $L_G$ immediately after unit C elevator has left, the passenger must wait a long time since said unit C has to service the service area and then return to building lobby $L_G$.

As explained above in a further example of the sky lobby system, two sky lobbies are used, one with dedicated sky lobby shuttle elevator arranged next to another dedicated sky lobby shuttle elevator. Consequently, the elevator shaft space takes up about ¼ to ⅓ of the overall space of the building, which is undesirable.

Usually, as the building becomes height increases, the space occupied by the elevator shaft also increases, and the effective space of the building becomes smaller (for example, in Landmark Tower in Yokohama, Japan, the space occupied by the elevator shaft is about ⅓ of the overall space of the building).

Moreover, the total required capacity of the elevator equipment may be much greater than that for the zone system.

In addition, in an ultra-high skyscraper at least 500 m tall, it is predicted that plural (3 or more) sky lobbies should be used. In this case, too, it is necessary to arrange a dedicated shuttle elevator for each sky lobby. Here, the shuttle elevator uses most of the elevator shaft space as an express region, and an increase in the number of the shuttle elevators leads to an increase in ineffectively used space in the express region, which is undesirable.

The purpose of the present invention is to solve the aforementioned problems of the prior art by providing an elevator device of a multi-sky-lobby system characterized by the fact that the space of the elevator shaft and the space required for the entire elevator system can be reduced, and, at the same time, the speed can be reduced so that the necessary motor capacity is decreased; in addition, movement between various floors is simplified.

SUMMARY OF THE INVENTION

In order to solve the aforementioned problem, the present invention provides an elevator system for a multi-sky-lobby system characterized by the following facts: the elevator system moves up and down along the elevator shaft of a building; it has a building lobby on the ground floor and plural sky lobbies set separated from each other by a prescribed number of floors; also, it has a first bank that connects said building lobby to said sky lobby adjacent to said building lobby, and banks 2 through n (where n is a positive number of 3 or more) that connect adjacent sky lobbies to each other; it has local elevators which stop at all of the floors in said banks, respectively; and it has a shuttle elevator which is arranged next to said local elevators and stops only at said building lobby and plural sky lobbies; and each of the aforementioned sky lobby floors has a constitution for use also as a transfer floor between said shuttle elevator and local elevators.

Also, in the elevator device for a multi-sky-lobby system of the present invention, said shuttle elevator has an upper shuttle elevator that stops at the upper sky lobby floors of said plural sky lobbies, and a lower shuttle elevator that stops at the lower sky lobby floors of said plural sky lobbies.

In addition, in the elevator device for a multi-sky-lobby system of the present invention, said shuttle elevator has a first shuttle elevator that stops at the uppermost sky lobby of the lower sky lobbies of said plural sky lobbies and said building lobby, a second shuttle elevator that is arranged next to said first shuttle elevator and stops at said plural lower sky lobbies and said building lobby, and a third shuttle elevator that is arranged next to said second shuttle elevator and stops at the plural upper sky lobbies of said plural sky lobbies.

Moreover, in the elevator device for a multi-sky-lobby system of the present invention, said local elevators have a constitution such that they provide service by making the floors in the zone connecting a prescribed bank on the lower side of said 2 to n banks and said building lobby bypassed floors.

The following benefits are realized by the present invention follow from the foregoing description.

It is possible to eliminate the express region for all local elevators, and it is possible to reduce the space occupied by said local elevators and to lower the speed.

Also, it is possible to reduce the maximum area occupied by elevator shafts on each floor. In addition, since there is no express region for the local elevators, and the speed can be lowered, it is possible to reduce the motor capacity, and to eliminate noise problems.

Travel between all of the banks (between floors) is simplified. That is, since the shuttle elevator stops at plural sky lobbies, compared to the prior art, it is possible to reduce the number of transfer cycles, the travel time, and the waiting time. Also, it is possible to make transfer in the same direction during travel.

When the system of the present invention designed for the same service level is compared with the prior art, the following advantages, as shown in FIG. 7, appear. Also, FIG. 7 shows the results of estimated calculations for the elevators of a single-deck system and a double-deck system in a building of 60 to 80 floors.

The space required by the entire elevator system can be reduced. If the space is 100% in the design of a conventional zone system, then the space required by the system of the present invention will be 65–70%.

It is possible to reduce the maximum space occupied on each floor. If the space is 100% in the design of a conventional zone system, the space required by the system of the present invention will be 60–65%.

It is possible to reduce the necessary total capacity of the elevator equipment, that is, total capacity equal to speed× load×number of sets. If the capacity is 100% in the design of a conventional zone system, the capacity required by the system of the present invention will be 80–90%.

The effects of the present invention are not limited to a single-deck elevator. The same effects can also be realized for a double-deck elevator. Also, the effects of the present invention become more significant for taller buildings.

DETAILED DESCRIPTION OF THE PREFERRED EMBODIMENTS

In the following, embodiments of the present invention will be explained with reference to the figures. In the constitution of the present invention, all of the connection floors and transfer floors in the elevator system of the conventional system (zone or sky lobby) are used as sky lobbies (a sky lobby for each bank of the local elevator), and a shuttle elevator is arranged to service the lobbies (sky lobbies) of the various banks of the local elevators (when there is a significant increase in the bank number, the shuttle elevators are zoned).

Figure 1:
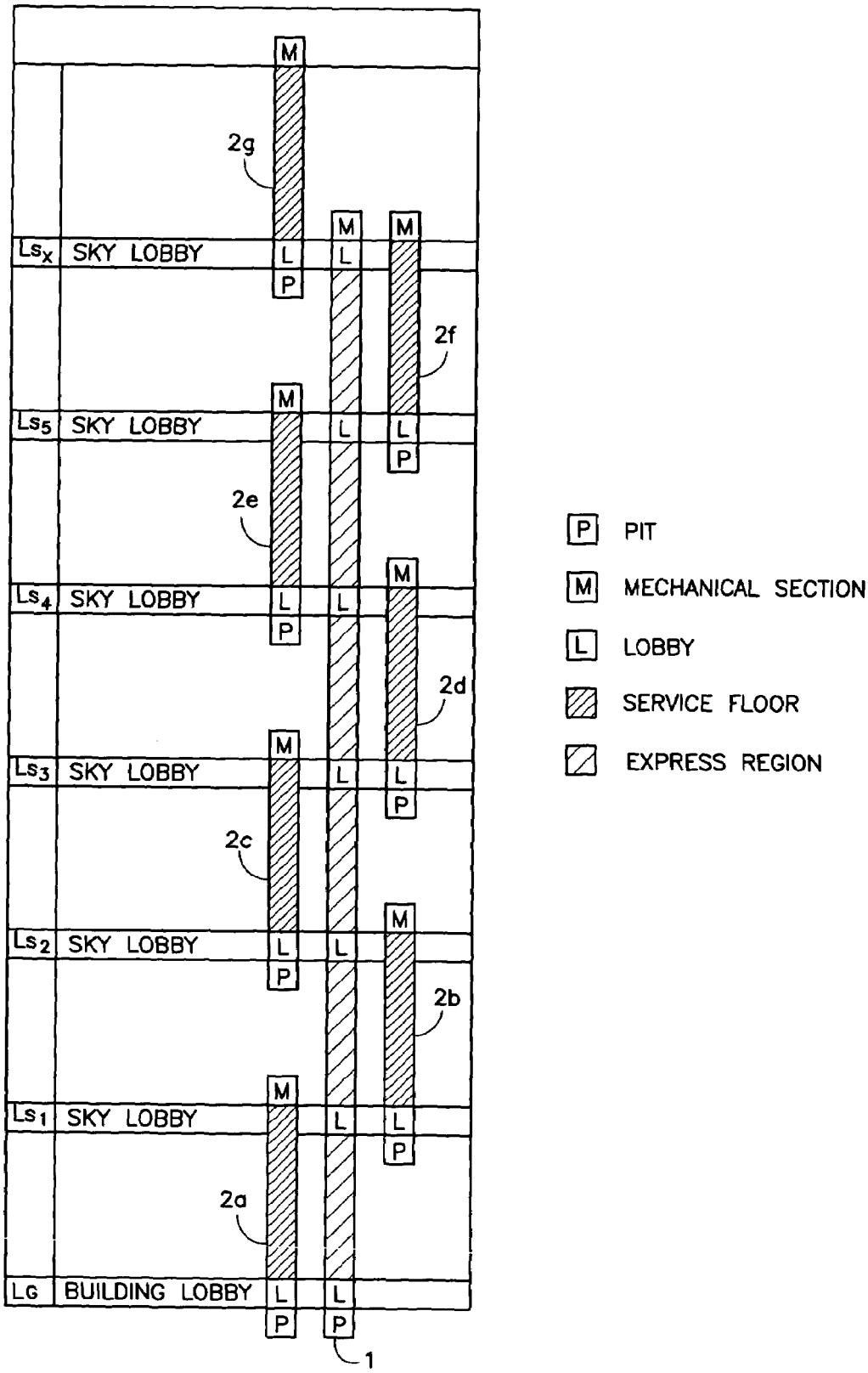
FIG. 1 is a diagram illustrating the constitution of the elevator device in an embodiment of the present invention.

In FIG. 1, $L_G$ represents the building lobby at ground level. Sky lobbies $Ls_1$–$Ls_x$ are arranged above said building lobby, with a prescribed number of floors between them. (1) represents a shuttle elevator that stops only at said building lobby $L_G$ and sky lobbies $Ls_1$–$Ls_x$, and the floors in the region between said lobbies are used the express region.

(2*a*) represents a local elevator that services various floors in the first bank that connects building lobby $L_G$ and sky lobby $Ls_1$; (2*b*) represents a local elevator that services various floors in the second bank that connects building lobby $Ls_1$ and sky lobby $Ls_2$; (2*c*) represents a local elevator that services various floors in the third bank that connects sky lobby $Ls_2$ and sky lobby $Ls_3$; (2*d*) represents a local elevator that services various floors in the fourth bank that connects building lobby $Ls_3$ and sky lobby $Ls_4$; (2*e*) represents a local elevator that services various floors in the fifth bank that connects sky lobby $Ls_4$ and sky lobby LS 5; (2*f*) represents a local elevator that services various floors in the sixth bank that connects building lobby $Ls_5$ and sky lobby $Ls_x$; and (2*g*) represents a local elevator that services various floors in the seventh bank that connects sky lobby $Ls_x$ and the uppermost floor.

For example, local elevators (2*a*), (2*c*), (2*e*), (2*g*) that service said odd-numbered banks are arranged along the first elevator shaft, and local elevators (2*b*), (2*d*), (2*f*) that service said even-numbered banks are arranged along a second elevator shaft arranged next to said first elevator shaft.

Said sky lobbies $Ls_1$ to $Ls_x$ have a constitution that allows them also to be used as transfer floors for said shuttle elevator and local elevators.

In FIG. 1, "P" stands for elevator pit; "M" stands for the mechanical section; and "L" stands for lobby. The densely hatched areas indicate service floors (serviced floors), and the widely hatched areas indicate express regions (bypassed floors).

As explained above, shuttle elevator (1) stops at all of sky lobbies $Ls_1$–$Ls_x$; when a passenger is going from building lobby $L_G$ to a floor above sky lobby $Ls_1$, the passenger rides shuttle elevator (1) and then transfers to the local elevator that services the destination floor. As a result, the passenger can reach the destination floor quickly by making only a single transfer.

Also, it is possible to move between various banks easily and quickly. For example, when the passenger wants to go from a given floor in the first bank (with local elevator (2*a*)) to a given floor in the fifth bank (with local elevator (2*e*)), the passenger first rides local elevator (2*a*) to sky lobby $Ls_1$ or building lobby $L_G$, where the passenger transfers to shuttle elevator (1) to go to sky lobby $Ls_4$, where the passenger again transfers to local elevator (2*e*).

In this case, because shuttle elevator (1) stops only at sky lobbies $Ls_1$–$Ls_4$, it can reach the destination floor very quickly. For example, if nobody gets on at the intermediate sky lobbies, the elevator can move directly to sky lobby $Ls_4$, so that the travel time can be shortened significantly.

Also, even when the passenger arrives at sky lobby $Ls_1$ or building lobby $L_G$ immediately after shuttle elevator (1) has started its ascent, the passenger still must only wait a short time since shuttle elevator (1) uses the regions of the various sky lobbies as an express region.

In the embodiment shown in FIG. 1, it is possible to eliminate the express regions of all local elevators (2*a*)–(2*g*), and the space used by the local elevators can be significantly reduced.

Also, since there is no express region for local elevators (2*a*)–(2*g*), it is possible to reduce the speed. As a result, the motor (hoisting device) capacity and the noise level can be reduced.

Also, since there is only one group of shuttle elevators for all of the sky lobbies, the space required for the overall elevator system, the maximum space occupied on each floor, the total capacity of the elevator equipment, etc., can all be reduced.

Also, it is not necessary to arrange said odd-numbered local elevators (2*a*), (2*c*), (2*e*), (2*g*) along the first elevator shaft. Other configurations may also be adopted. Also, it is not necessary to arrange said even-numbered local elevators (2*b*), (2*d*), (2*f*) along the second elevator shaft. Other configurations may also be adopted. For example, said odd-numbered local elevators can be arranged in a spiral, with the even-numbered local elevators arranged along another spiral.

FIG. 1 illustrates an example in which a single-deck elevator is adopted. However, the same operation and effects can be realized for the case of a constitution of a double-deck elevator.

In the following, the embodiment of the shuttle elevator of the present invention will be explained for a zone constitution in which the shuttle elevator is divided into two portions, namely, an upper sky lobby and a lower sky lobby. The same part numbers as those in FIG. 1 are used in FIG. 2. This case differs from that shown in FIG. 1 in that it has upper shuttle elevator (1*a*), which stops only at building lobby $L_G$ and upper sky lobbies $Ls_4$–$Ls_x$, and it phases through the various floors between the lobbies, which are designated as express regions, and lower shuttle elevator (1*b*), which stops only at building lobby $L_G$ and lower sky lobbies $Ls_1$–$Ls_4$, and it phases through the various floors between the lobbies, which are designated as express regions.

As explained above, since shuttle elevators (1*a*) and (1*b*) are combined, they stop at all sky lobbies $Ls_1$–$Ls_x$. Consequently, when a passenger wants to go from building lobby $L_G$ to an upper floor above sky lobby $Ls_1$, the passenger need only make one transfer from shuttle elevator (1*a*) or (1*b*) to the local elevator that services the destination floor. As a result, the passenger can reach the desired floor quickly.

Also, moving between banks can be done easily and quickly. For example, when the passenger wants to go from a certain floor in the first bank (with local elevator (2*a*)) to a certain floor in the fifth bank (with local elevator (2*e*)), the passenger uses local elevator (2*a*) to reach building lobby $L_G$, where the passenger transfers to shuttle elevator (1*a*) and goes directly to sky lobby $Ls_4$, where the passenger again transfers to local elevator (2*e*) to reach the destination floor.

In this case, because shuttle elevator (1*a*) stops only at sky lobby $Ls_4$, the passenger can reach the destination floor very quickly.

Also, if the passenger arrives at building lobby $L_G$ immediately after shuttle elevator (1*a*) has started its ascent, the passenger can still wait only a short time because shuttle elevator (1*a*) moves quickly through the various sky lobbies, which are used as express regions.

Figure 2:
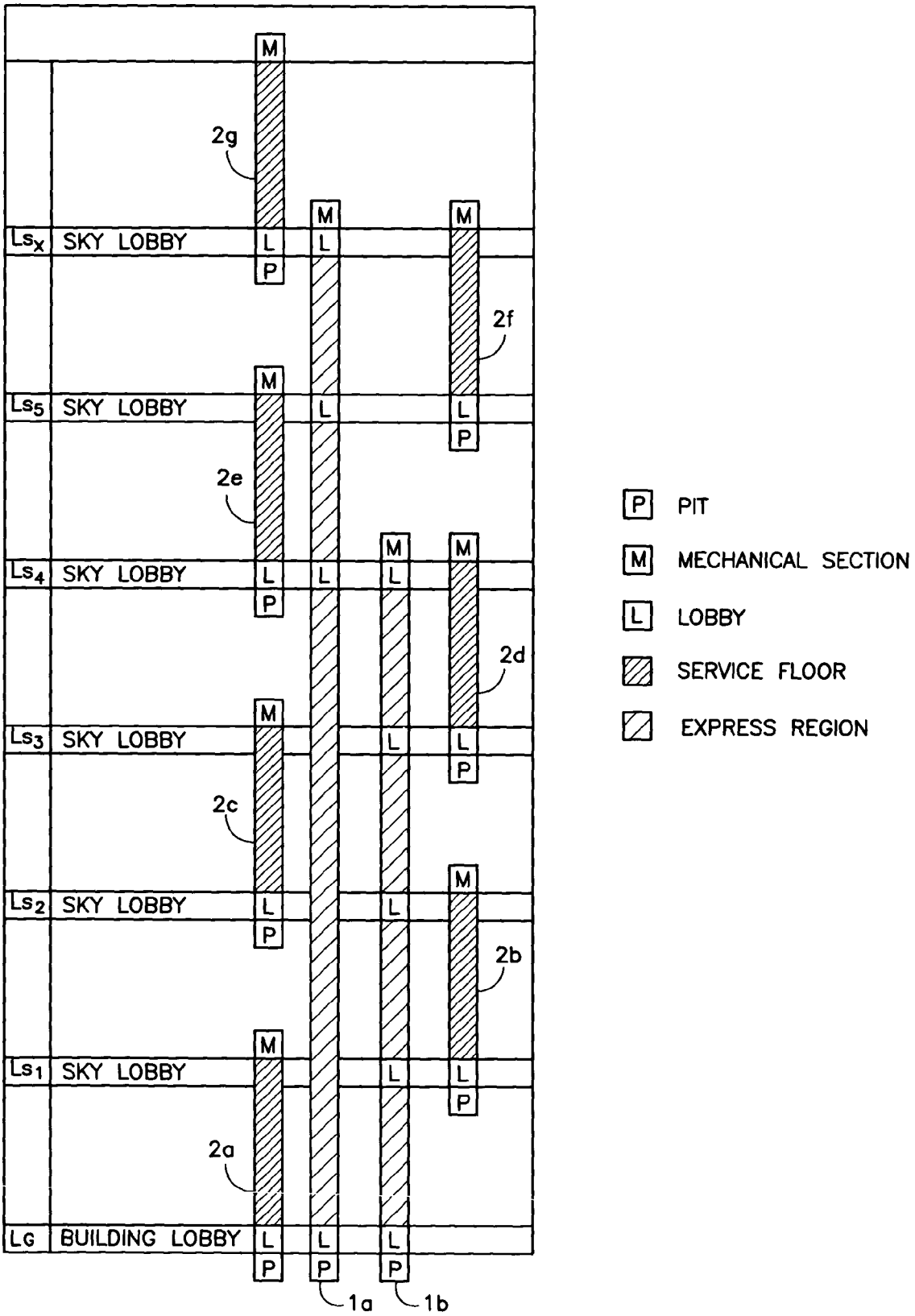
FIG. 2 is a diagram illustrating the constitution of the elevator device in another embodiment of the present invention.

In the embodiment shown in FIG. 2, the express regions can be eliminated for all local elevators (2*a*)–(2*g*), so that it is possible to reduce the space required by the local elevators significantly.

Also, since there is no express region for local elevators (2*a*)–(2*g*), it is possible to lower the elevator speed. As a result, the capacity of the motor (hoisting device) can be reduced, and at the same time, the noise level can be lowered.

Also, since there are two groups of shuttle elevators for all sky lobbies, it is possible to reduce the space required for the entire elevator system, the maximum space occupied by each floor, the total capacity of the elevator equipment, etc.

FIG. 2 is a diagram illustrating an application example for a single-deck elevator. However, the same operation and effects as mentioned above can be realized in the case of a double-deck elevator.

Figure 3:
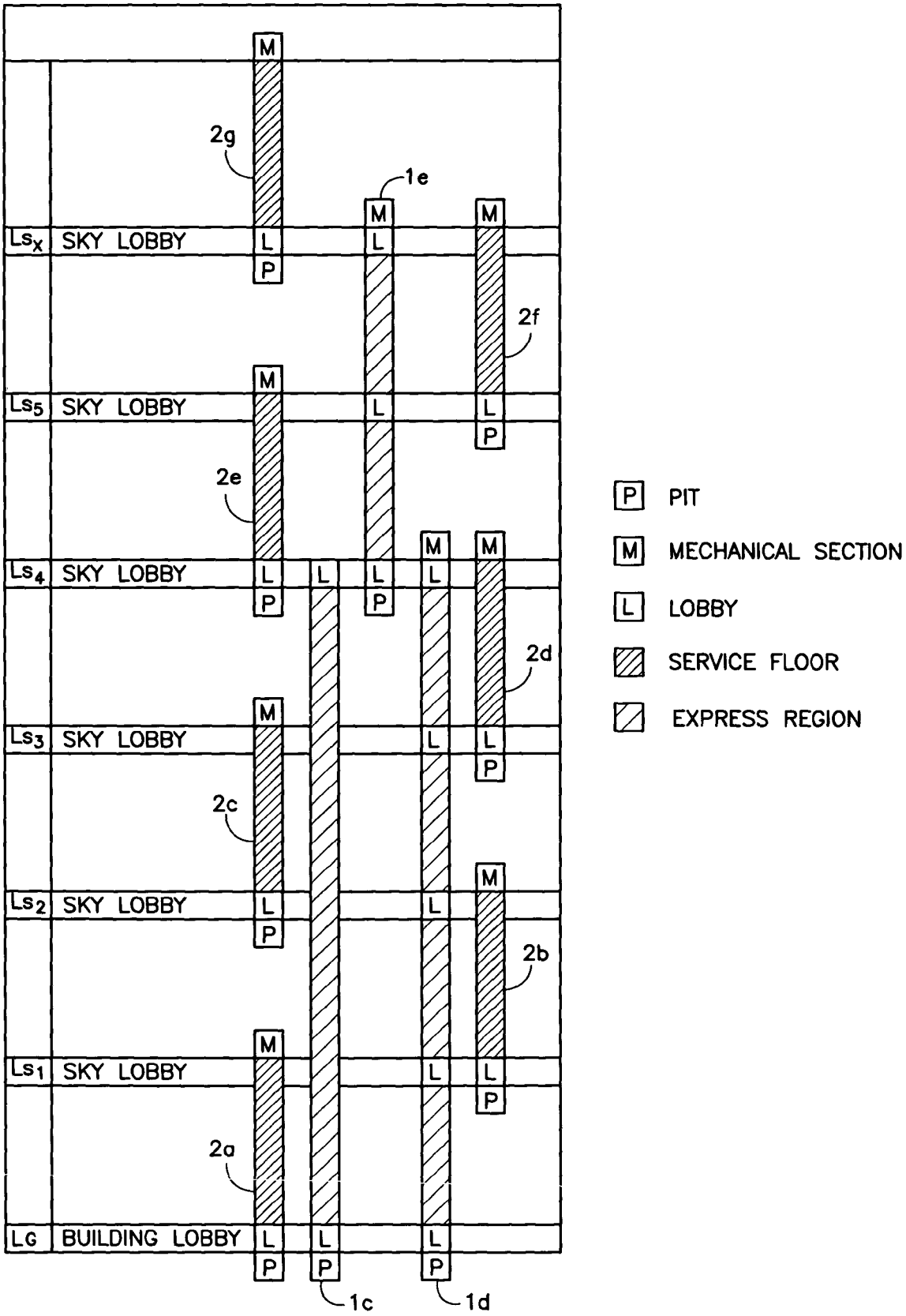
FIG. 3 is a diagram illustrating the constitution of the elevator device in another embodiment of the present invention.

In the embodiment shown in FIG. 2, if the building is ultrahigh or superhigh, the total length of shuttle elevator (1*a*) will be very long (that is, it is extremely high); the capacity of the motor (hoisting device) may thus be limited. In this case, in another embodiment, the constitution shown in FIG. 3 may be used in which shuttle elevator (1*a*) shown in FIG. 2 is divided into two areas (upper and lower areas). In FIG. 3, the same part numbers that appear in FIG. 2 are used.

The scheme shown in FIG. 3 differs from that shown in FIG. 2 in that, here, the shuttle elevators include shuttle elevator (1*c*), which stops only at building lobby $L_G$ and upper sky lobby $Ls_4$ and which moves by using the various floors between lobbies as an express region, shuttle elevator (1*d*), which stops only at building lobby $L_G$ and plural lower sky lobbies $Ls_1$–$Ls_4$ and which moves by using the various floors between lobbies as an express region; and shuttle elevator (1*e*), which stops only at plural upper sky lobbies $Ls_4$–$Ls_x$ and which moves by using the various floors between lobbies as an express region.

In this embodiment, the elevator device of the present invention can accommodate even very tall buildings simply by arranging shuttle elevators of the same type as shuttle elevator (1*e*), and local elevators of the same type as local elevators (2*f*), (2*g*) in tandem on the upper side.

As explained above, by means of a combination of shuttle elevators (1*c*)–(1*e*), all sky lobbies $Ls_1$–$Ls_x$ can be reached. Consequently, when the passenger wants to go from building lobby $L_G$ to sky lobby $Ls_1$, the passenger can quickly move to reach the destination floor by making one or two transfer cycles from the shuttle elevator to the local elevator that services the destination floor.

Also, travel between banks can be carried out easily and quickly. For example, when the passenger wants to move from a certain floor in the first bank (with local elevator (2*a*)) to a certain floor in the fifth bank (with local elevator (2*e*)), the passenger rides local elevator (2*a*) to reach building lobby $L_G$, where the passenger transfers to shuttle elevator (1*c*) and goes to sky lobby $Ls_4$, where the passenger again transfers to local elevator (2*e*) to reach the destination floor.

In this case, because shuttle elevator (1*c*) stops only at sky lobby $Ls_4$, the passenger can quickly reach the destination floor.

Also, even when the passenger arrives at sky lobby $Ls_G$ immediately after shuttle elevator (1*c*) has started its ascent, the passenger still need only wait a short time because shuttle elevator (1*c*) moves directly to sky lobby $Ls_4$.

In the embodiment shown in FIG. 3, it is possible to eliminate the express regions of all local elevators (2*a*)–(2*g*), and the space required by the local elevators can be reduced significantly.

Also, since there is no express region for local elevators (2*a*)–(2*g*), it is possible to lower the elevator speed. As a result, the capacity of the motor (hoisting device) can be reduced, and the noise level can be reduced.

Also, since there are three groups of shuttle elevators for all sky lobbies, the space required for the overall elevator system, the maximum space occupied on each floor, the total capacity of the elevator equipment, etc., can all be reduced.

FIG. 3 illustrates an example in which a single-deck elevator is adopted. However, the same operation and effects can be realized for the case of a constitution of a double-deck elevator.

Figure 4:
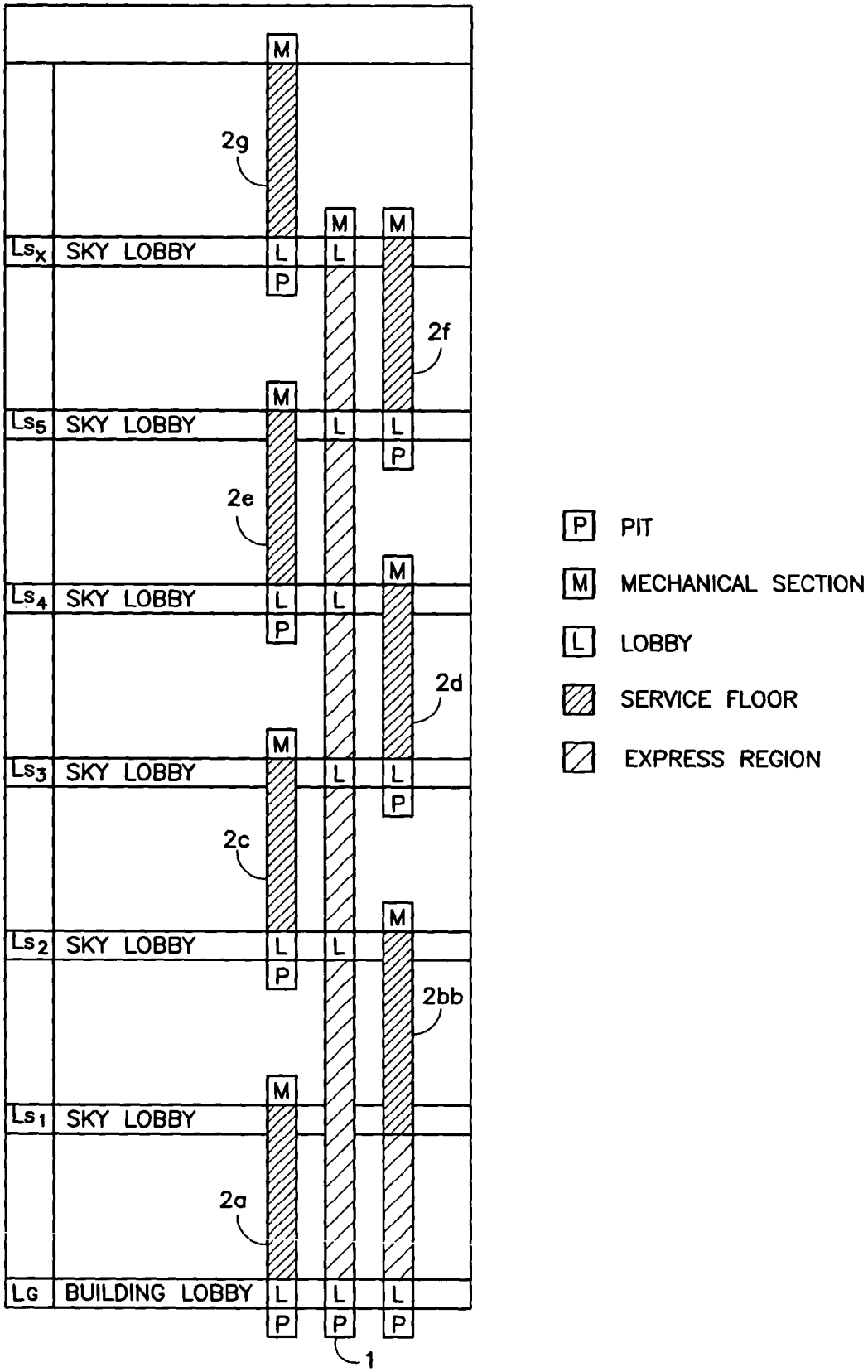
FIG. 4 is a diagram illustrating the constitution of the elevator device in another embodiment of the present invention.
Figure 5:
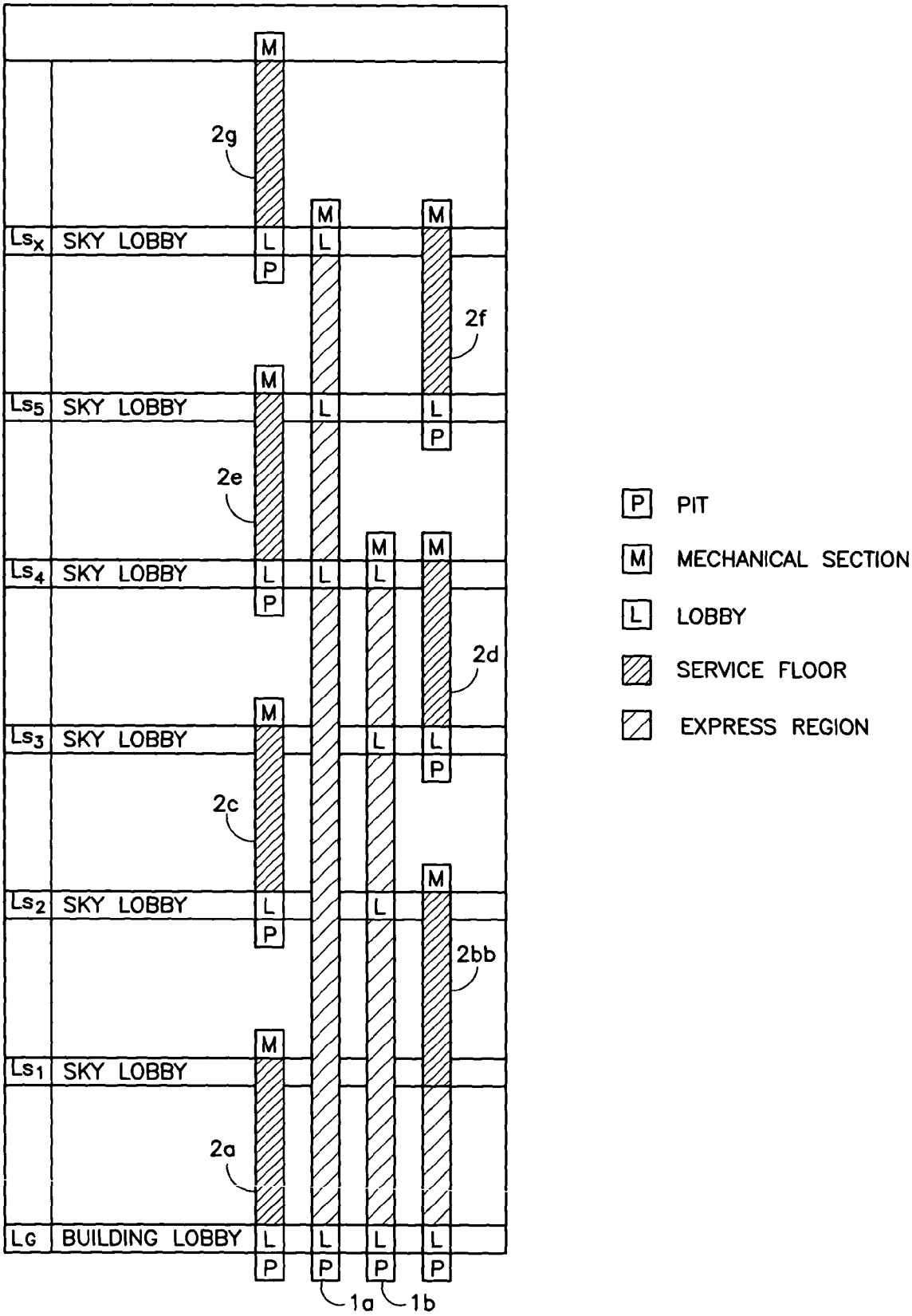
FIG. 5 is a diagram illustrating the constitution of the elevator device in another embodiment of the present invention.
Figure 6:
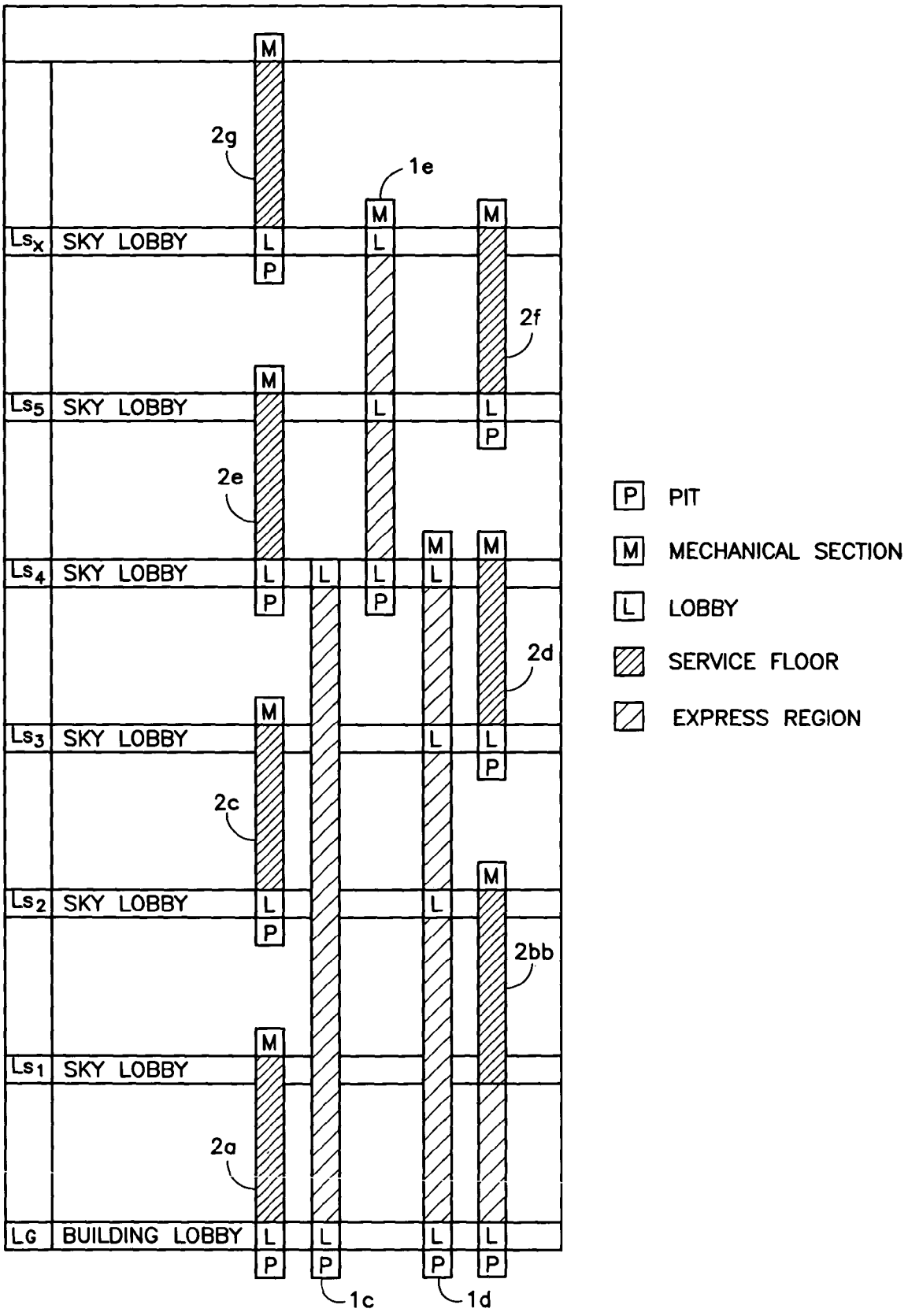
FIG. 6 is a diagram illustrating the constitution of the elevator device in another embodiment of the present invention.
Figure 7:
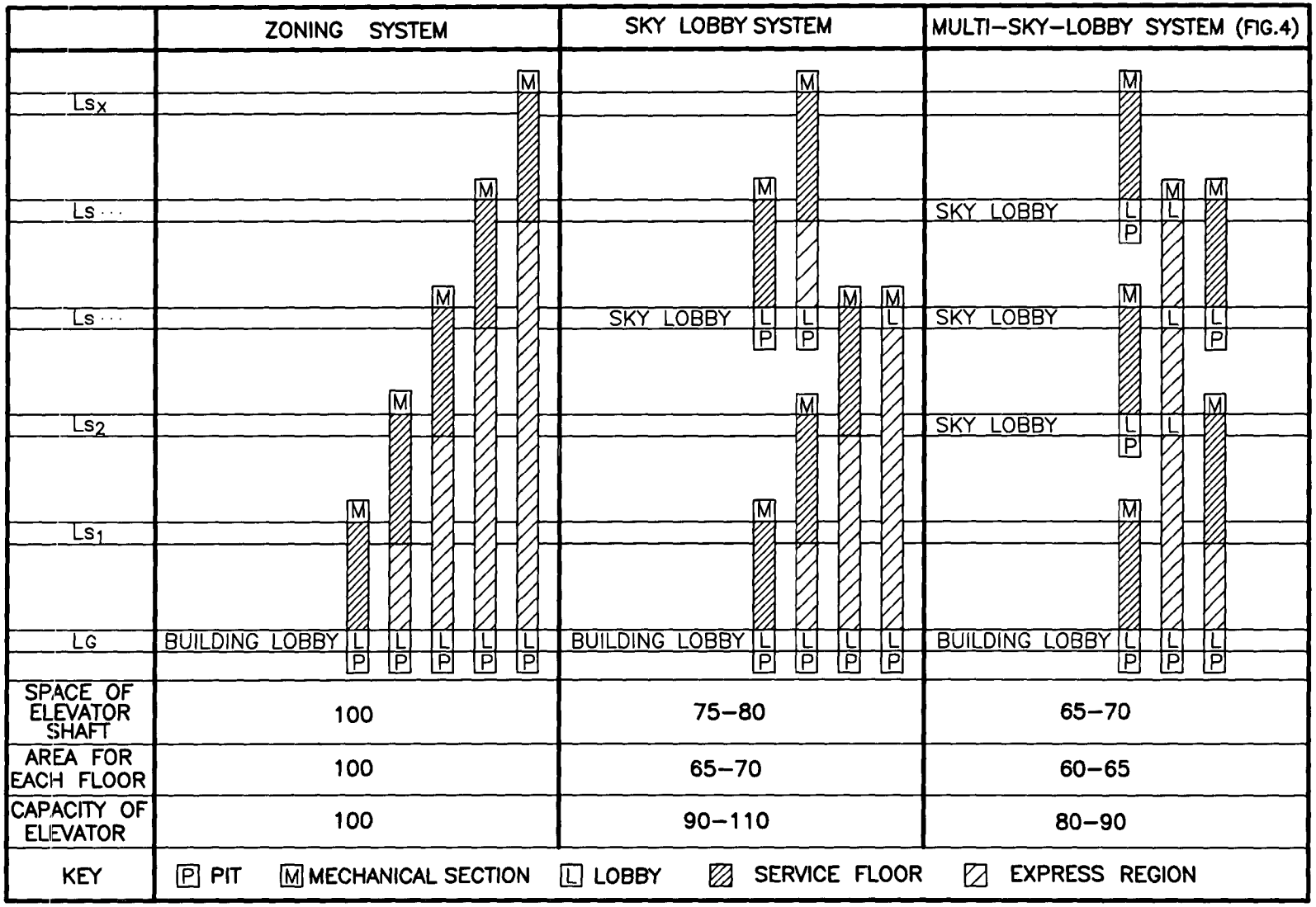
FIG. 7 is a diagram comparing the system of the present invention with the prior art.

Also, in order to improve convenience further and to reduce the load of the shuttle elevator, one may also adopt the constitution in which, as shown in FIGS. 4–6, direct zone service can be used from building lobby $L_G$ by local elevator (2*b*), which provides service for the second bank as shown in FIGS. 1–3.

That is, in the constitution shown in FIGS. 4–6, in place of local elevator (2*b*) shown in FIG. 1, elevator (2*bb*) is used to service the various floors in the second bank that connects sky lobby $Ls_1$ and sky lobby $Ls_2$, and at the same time, moves in the region between sky lobby $Ls_1$ and building lobby $L_G$ by making it an express region.

Shuttle elevator (1) shown in FIG. 4, shuttle elevator (1*b*) shown in FIG. 5, and shuttle elevator (1*d*) shown in FIG. 6 all have a constitution in which that they do not stop at sky lobby $Ls_1$. However, this occurs during the expected rush hour time period. They may stop during other time periods.

The embodiment shown in FIGS. 4–6 is highly effective in buildings with many offices and tenants on the floors near lower sky lobbies $Ls_1$ and $Ls_2$. Also, of course, FIGS. 4–6 exhibit the same operation and effects as associated with FIGS. 1–3.

Also, it is not necessary to use direct zone service from building lobby $L_G$ to the second (counted from the lower side) bank as shown in FIGS. 4–6. Instead, direct zone service from building lobby $L_G$ to the third, fourth, . . . banks (counting from the bottom) can be adopted.

Table 1 lists the calculation results when the elevator device is designed for various elevator systems.

TABLE 1

| SCHEME | DIRECT ZONE | SINGLE SKY LOBBY | DOUBLE SKY LOBBY | MULTI-SKY LOBBY |
|---|---|---|---|---|
| Total Number of EV (sets) | 32 | 34 | 34 | 32 |
| Total Capacity of Motor (kW) | 3920 | 4330 | 3925 | 3430 |
| Maximum number of elevator shafts occupied for each floor (sets) | 32 | 22 | 22 | 20 |
| Space occupied by elevator shafts and mechanical sections for all floors ($m^2$) (excluding EV hall of serviced floor and underground pit) | 23,260 | 18,239 | 18,413 | 16,443 |
| Space occupied by elevator shafts for each floor ($m^2$) (including EV hall of the serviced floor) | 544 | 380 | 378 | 344 |
| Rate of occupation of elevator shafts for each floor (%) (including EV hall of the serviced floor) | 15 | 11 | 11 | 10 |

Table 1 lists the calculation results for a simulation under the specified conditions that the transport rate in 5 min is 15% or more of the number of tenants, and the average starting period is 30 sec or less.

Figure 8:
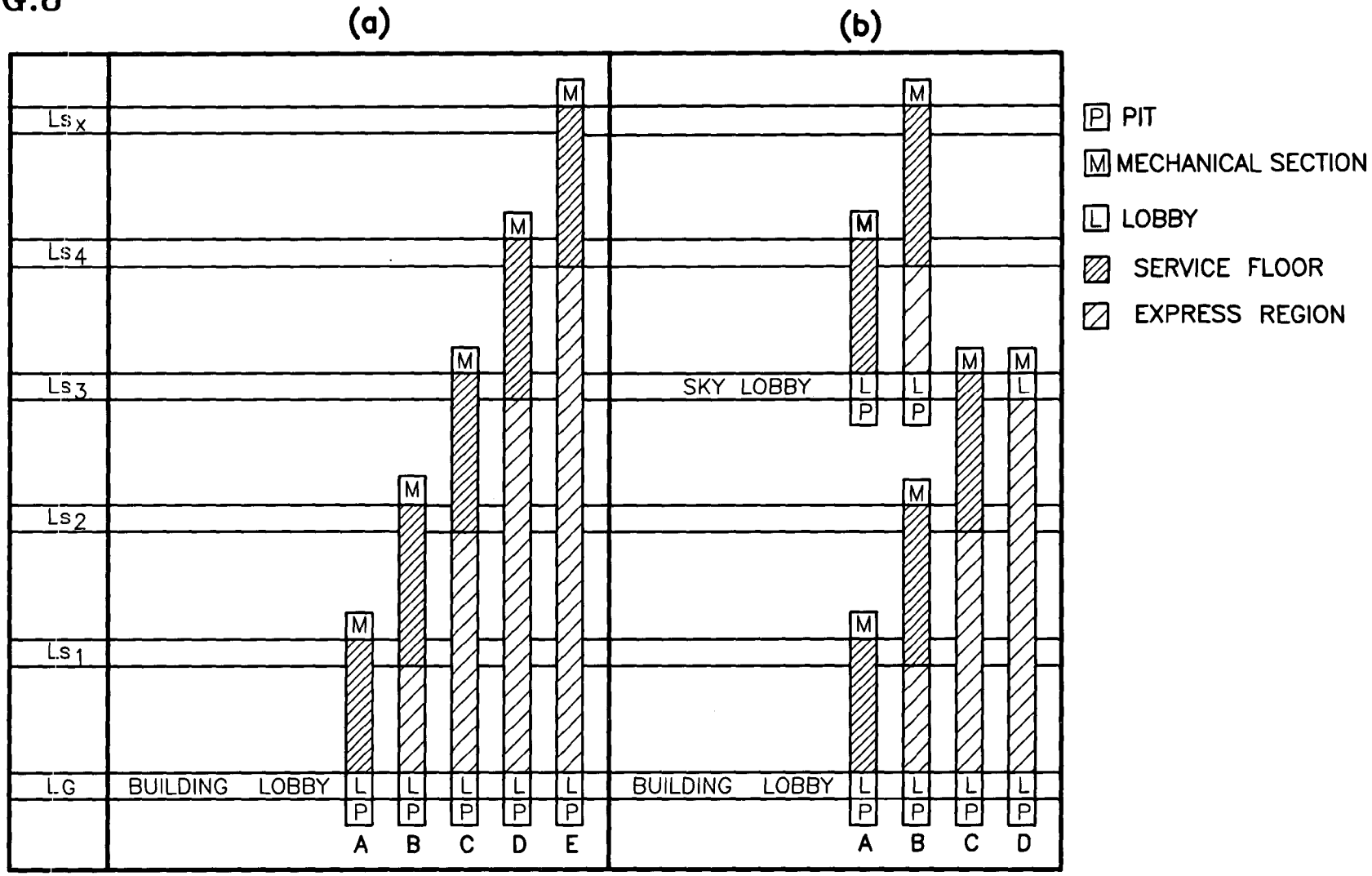
FIG. 8 illustrates the constitution of a conventional elevator device. (a) is a diagram illustrating the constitution of the zone system. (b) is a diagram illustrating the constitution of the sky lobby system.

In Table 1, "direct zone" refers to the system described in said FIG. 8(*a*). "Single sky lobby" refers to the system described in said FIG. 8(*b*). "Double sky lobby" refers to the system with additional sky lobbies added to the system shown in FIG. 8(*b*). "Multi-sky lobby" refers to the system described in FIG. 1 of the present invention.

The total capacity of motor listed in Table 1 is determined by speed×load×number of sets. This value is lowest for the multi-sky-lobby system of the present invention.

For the multi-sky-lobby system of the present invention, the maximum number of elevator shafts occupied by each floor, for example, is a total of 20 sets, including the 6-set managed elevator shaft for the odd-numbered local elevators (2*a*, 2*c*, 2*e*, 2*g*) shown in FIG. 1, the 8-set managed elevator shaft for shuttle elevator (1), and the 6-set managed elevator shaft for the even-numbered local elevators (2*b*, 2*d*, 2*f*). The number is lower than that of the prior art.

In addition, for the multi-sky-lobby system of the present invention, the area occupied by elevator shafts on each floor and the space occupied by elevator shafts on each floor are also less than those of the prior art. As a result, the multi-sky-lobby system of the present invention has less area occupied by elevator shafts and mechanical sections for all of the floors than that of prior art, and it also has lower operating costs than the prior art.

In the present invention, the number of sky lobbies, elevator cars, etc., is not limited to the values used in the aforementioned application examples. Other values may also be used. The preceding description is exemplary rather than limiting in nature. Variations and modifications to the disclosed examples may become apparent to those skilled in the art that do not necessarily depart from the purview and spirit of this invention. The scope of legal protection given to this invention can only be determined by studying the following claims.

We claim:

1. An elevator system having a building lobby and a plurality of sky lobbies located above the building lobby wherein each sky lobby is separated by at least one local floor, the elevator system comprising:

a plurality of shuffle elevator shafts for connecting the plurality of sky lobbies, a shuttle elevator being located for movement within each of the plurality of shuttle elevator shafts;

a first local elevator located for movement in a first local elevator shaft connecting a first one of said plurality of sky lobbies and a second one of said plurality of sky lobbies wherein said first local elevator provides service to the floors located between said first and second sky lobby, said second sky lobby vertically spaced apart from said first sky lobby in a first direction;

a second local elevator located in a second elevator shaft for movement therein connecting said first sky lobby with a third one of said plurality of sky lobbies wherein said second local elevator provides service to the floors located between said first and third sky lobbies, said third sky lobby vertically spaced apart from said first sky lobby in a second direction opposite said first direction; and, a third local elevator located in a third elevator shaft connecting a second one of said plurality of sky lobbies and a forth one of said plurality of sky lobbies wherein said third local elevator provides service to the floors located between said second and forth sky lobby, said third sky lobby vertically spaced in said first direction, said third local elevator shaft and said first local elevator shaft are located along a first vertical plane.

2. The elevator system of claim 1 wherein the first vertical plane is located adjacent one of the plurality of shuttle elevator shafts.

3. The elevator system of claim 1 wherein said second elevator shaft is located along a second vertical plane.

4. The elevator system of claim 2 wherein said first vertical plane and said second vertical plane are located on opposite sides of a common shuttle elevator shaft.

5. An elevator system having a building lobby and a plurality of sky lobbies located above the building lobby wherein each sky lobby is separated by at least one local floor, the elevator system comprising:

a shuttle elevator located for movement within a shuttle elevator shaft for connecting the plurality of sky lobbies;

a first plurality of local elevator shafts connecting a first set of said plurality of sky lobbies wherein each of said first plurality of local elevator shafts contains an elevator for providing service to the floors located between said first set;

a second plurality elevator shafts connecting a second set of said plurality of sky lobbies wherein each of said second plurality of local elevator shafts contains an elevator for providing service to the floors located between said second set wherein each elevator shaft of said first plurality of local elevator shafts is located along a first vertical plane and said second plurality of local elevator shafts is located along a second vertical plane, wherein said first vertical plane and said second vertical plane are located on opposite sides of the plurality of said shuttle elevator shafts.

6. The elevator system of claim 5 wherein the first vertical plane is located adjacent the shuttle elevator shafts.

7. The elevator system of claim 5 wherein the said second plurality of local elevator shafts is located along a second vertical plane.

* * * * *